United States Patent [19]

Coleman

[11] 4,008,121

[45] Feb. 15, 1977

[54] METHOD OF CURTAIN COATING PIGMENT PARTICLES ON PAPER PLIES

[75] Inventor: John Douglas Coleman, Surrey Hills, Australia

[73] Assignee: Commonwealth Scientific and Industrial Research Organization, Australia

[22] Filed: Dec. 4, 1974

[21] Appl. No.: 529,584

[30] Foreign Application Priority Data

Dec. 10, 1973 Australia ..... 5934/73
Sept. 9, 1974 Australia ..... 8820/74

[52] U.S. Cl. ..... 162/124; 162/132; 162/175; 162/181 D; 162/186; 427/420; 428/342

[51] Int. Cl.[2] ..... D21H 1/02; D21H 1/22; D21H 1/24

[58] Field of Search ..... 162/124, 128, 175, 181 D, 162/186, 204, 266, 299, 300, 303, 304, 322, 344, 132; 427/420; 428/342, 533; 118/325, DIG. 4

[56] References Cited

UNITED STATES PATENTS

| | | | |
|---|---|---|---|
| 1,344,603 | 6/1920 | Warren | 162/266 |
| 1,538,582 | 5/1925 | Olander et al. | 162/266 |
| 1,903,236 | 3/1933 | Johnsen | 162/186 |
| 2,007,470 | 7/1935 | Harvey | 162/124 |
| 2,286,924 | 6/1942 | Nicholson | 162/124 |
| 2,708,643 | 5/1955 | Page et al. | 428/342 |
| 2,830,916 | 4/1958 | Brown | 428/342 X |
| 3,508,952 | 4/1970 | Eykamp et al. | 428/342 |
| 3,560,334 | 2/1971 | Arledter | 162/266 |

FOREIGN PATENTS OR APPLICATIONS

| | | | |
|---|---|---|---|
| 1,904,962 | 8/1970 | Germany | 162/303 |

*Primary Examiner*—S. Leon Bashore
*Assistant Examiner*—Richard V. Fisher
*Attorney, Agent, or Firm*—Cushman, Darby & Cushman

[57] ABSTRACT

In order to opacify one side of a multi-ply paperboard comprised of a plurality of paper plies, pigment particles are spread between a pair of the plies. Pigment particles are preferably clay particles and are preferably spread immediately beneath the outermost ply at the one side of the board at a distribution of between 5 grams per square meter and 60 grams per square meter.

5 Claims, 4 Drawing Figures

METHOD OF CURTAIN COATING PIGMENT PARTICLES ON PAPER PLIES

BACKGROUND OF THE INVENTION

1. Field of the Invention

This invention relates to the manufacture of paperboard. More particularly it is directed to the achievement of economies in the consumption of bleached pulp during manufacture of white lined paperboard suitable for printing.

2. Description of Prior Art

Conventional white lined multi-ply liner board and box board comprises a dull grey waste paper base overlaid by several layers made from progressively higher whiteness bleached pulps. The bleached pulp normally contains some white pigment to whiten, brighten and opacify the board and improve its suitability for printing.

SUMMARY OF THE INVENTION

By the present invention one or both sides of a multi-ply paperboard can be opacified by spreading pigment particles over one or more of the ply surfaces and the consumption of bleached pulp can be reduced either by eliminating bleached pulp plies or reducing their weight.

Specifically the present invention provides a method of forming multi-ply paperboard comprising the steps of forming a first paper ply and building further plies onto the first ply wherein, in order to opacify one side of the paperboard pigment particles are spread between a pair of said plies.

The invention also extends to a multi-ply paperboard comprising a plurality of superposed paper plies wherein there is between a pair of said plies a spread comprised of pigment particles.

The pigment particles may be suspended in a liquid binder and the suspension applied between said pair of plies.

The pigment particles may be comprised of clay and/or titanium dioxide particles and the liquid binder may be comprised of a starch solution, carboxy methyl cellulose, polyvinyl alcohol, casein or synthetic lattices.

By the invention of copending U.S. patent application Ser. No. 477,380, filed June 7, 1974, there is provided a curtain coating apparatus by which it is possible to apply an even layer of a liquid binder such as a starch solution between the plies of a multi-ply paperboard in order to increase strength of the board. The same apparatus may be used for carrying out the method of the present invention simply by adding pigment particles to the liquid binder. Thus the suspension of pigment particles in the liquid binder may be spread by the technique of forcing it through a horizontal slot so that it wets both upper and lower edges of the slot and is extruded generally horizontally from the slot to fall downwardly under gravity across an upright surface of a wall which terminates at the bottom blade edge to establish a falling curtain of the liquid suspension over the surface and allowing the established curtain to fall away from said surface at the blade edge and onto said one ply surface.

By concentrating the pigment material into a discrete layer or stratum, the maximum opacifying effect is achieved. It is therefore preferred to concentrate the pigment in a single layer or stratum beneath the outermost ply which may be very thin. In fact the outermost ply merely serves to overlay and protect the pigment material and modify the printing quality of the board surface and prevent transfer of pigment and binder to elements of the board making machine. It would be possible, however, to apply pigmented layers between intermediate plies of the paperboard.

It has been found that a clay distribution of about 5 grams per square meter beneath the outermost ply will significantly increase whiteness and opacity of the board. This would represent about 1% of the weight of a normal multi-ply paperboard. Further increases in whiteness and opacity can be achieved by increasing the clay content toward an upper limit of about 60 grams per square meter at which level a dense white coating is achieved. In a typical paperboard a clay distribution of 60 grams per square meter will represent about 15% of the total weight of the board, which is a commercially practicable proportion.

Although it is preferred to apply the pigment particles in suspension in a liquid binder, since this is a most convenient manner of achieving an even pigment distribution and also promotes interply bonding, it is to be understood that it would be possible to apply a spread of pigment particles without binder, for example by a spray technique, and it is to be understood that the invention extends to such a process and the resulting product.

In a paperboard made in accordance with the present invention, the bleached pulp plies may be reduced in weight and/or reduced in number.

Thus very great economies in the use of such pulp can be achieved. Pulps of lower cost and whiteness can also be used in such liners. It is possible to use sufficiently high concentrations of pigment material to keep water addition below a level at which it would interfere with the paper machine operation. The liquid binder can be handled by the curtain coating apparatus and it also promotes interply bonding in the paperboard.

In order that the invention may be more fully understood, one particular method of making a paperboard will be described with reference to the accompanying drawings.

DESCRIPTION OF THE PREFERRED EMBODIMENT

Figure 2:
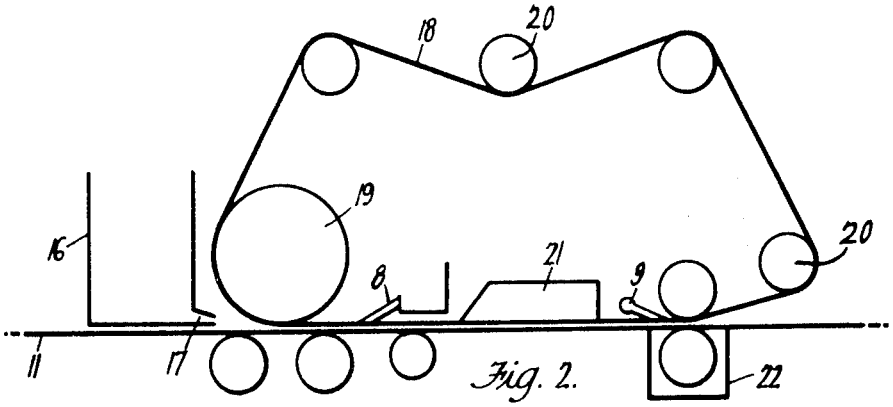
FIG. 2 is an enlarged horizontal elevation of one stage in the Inverform machine.

The illustrated apparatus comprises an Inverform machine which manufactures a board consisting of four paper plies. The machine has an endless carrier web 11 driven continuously through a loop around support rollers 10 by drive means (not shown). The machine comprises four ply-forming stages 12, 13, 14, 15. Each of these has the general construction which is illustrated in more detail in FIG. 2. As seen in this Figure a flow box 16 is located directly above the carrier web 11 to deposite pulp onto the carrier through slot outlet 17. The deposited layer of pulp is held between carrier web 11 and a further web or "top wire" 18 as it passes beneath a forming roller 19 and between upper and lower vacuum boxes 21, 22 by means of which it is dewatered to form a consolidated ply. The "top wire" 18 moves around a closed loop supported on rollers 20. An autoslice 8 and a suction slice 9 are also provided in each stage.

In each stage the top wire 18 is driven through an endless loop and it comes away from the ply at the end of this stage. Thus, the upper surface of the ply formed in each of the first three stages is exposed briefly before entering the next ply-forming stage of the machine. Layers of starch solution are deposited on the two exposed ply surfaces between the first and second forming stages and between second and third forming stages and a layer of starch solution with suspended clay particles is applied to the exposed ply surface between the third and fourth forming stages. The outermost ply formed by stage 15 would be made from bleached pulp but the other plies could be formed of pulp reclaimed from waste paper. The outermost ply may be very thin and serve merely to overlay and protect the piment material and prevent transfer of pigment and binder to the components of machine stage 15.

Figure 1:
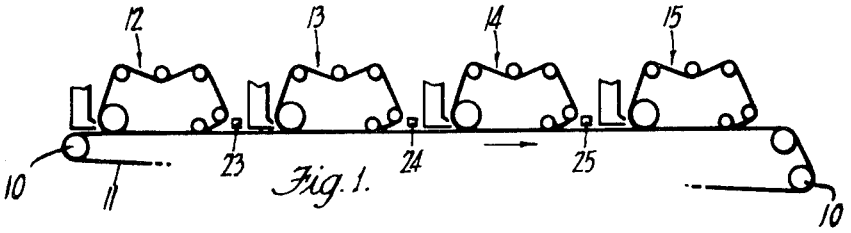
FIG. 1 is a diagrammatic elevation of a modern high speed Inverform machine which has been modified by the addition of curtain coaters for carrying out the method of the present invention.
Figure 3:
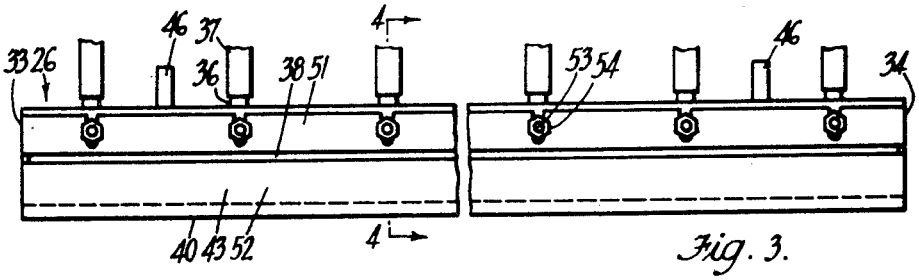
FIG. 3 is an elevation of one of the curtain coaters.
Figure 4:
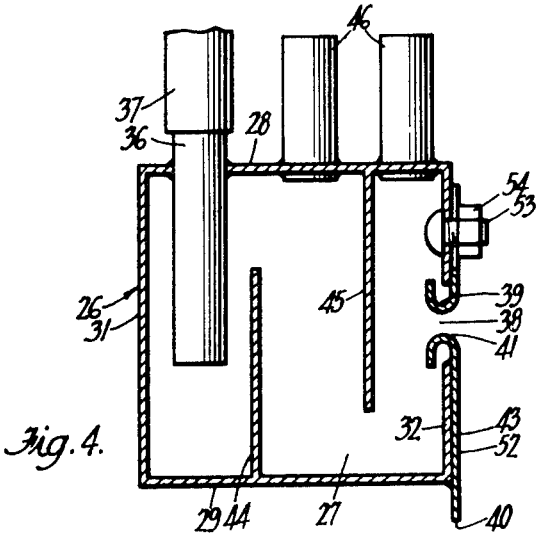
FIG. 4 is a cross-section on the line 4—4 in FIG. 3.

The three inter-ply layers are deposited by means of curtain coaters indicated in FIG. 1 as 23, 24, 25. They are of identical construction, this construction being illustrated in FIGS. 3 and 4. Each comprises a horizontal elongate hollow structure 26, the interior of which serves as a liquid receiving pressure chamber 27. Structure 26 may be made from sheet metal as a long box of rectangular cross-section. It has top and bottom walls 28, 29, side walls 31, 32 and end walls 33, 34. Chamber 27 may be about 2 inches wide by 2 inches deep in a typical structure 26 would need to be about 15 feet long or even more.

The top wall 28 of structure 26 is provided with liquid inlet tappings 36 to which liquid supply pipes 37 are connected. Tappings 36 and pipes 37 together form liquid inlet ducts which extend downwardly into chamber 27 at locations adjacent side wall 31 and therefore remote from side wall 32. Inlet tappings 36 are spaced at regular intervals throughout the length of structure 26. Inlet pipes 37 are supplied with liquid starch under pressure. Pipes 37 may, for example, be branches of a single supply manifold.

Side wall 32 of structure 26 is provided with a horizontal slot outlet 38 defined between upper and lower lips 39, 41 formed on upper and lower plates 51, 52 fastened to the outer-face of wall 32. Upper plate 51 is fastened to wall 32 by studs 53 and into 54 so that the position of upper lip 39 can be adjusted to vary the width of the slot outlet whereas lower plate 52 is permanently fixed to wall 32 by welding or a suitable adhesive. Lips 39, 41 are rounded being formed by suitable curving the respective margins of plates 51, 52. Plate 52 defines an external upright surface 43 extending downwardly from lower lip 41 of slot outlet. It extends below the bottom wall 29 of structure 26 to terminate in a sharp blade edge 40 at the bottom of surface 43.

Vertical baffle plates 44, 45 are fitted within structure 26 to obstruct direct flow of liquid from inlet tappings 36 to the outlet slot 38. More particularly baffle 44 extends upwardly from the bottom wall 29 adjacent tappings 36 to an upper edge which is above the bottom ends of the tappings. Baffle 45 extends downwardly from top wall 28 adjacent slot 38 to a lower edge below the level of the slot. The starch pumped into the chamber via tappings 36 is therefore caused to flow in a sinuous path to reach slot 38.

Vent pipes 46 are fitted to the upper wall 28 of structure 26 to vent the upper part of the chamber 27 to atmosphere.

The liquid starch or starch and clay, as the case may be, is metered by pumping into the chamber 27 under pressure and fills the chamber to a level above slot outlet 38. The liquid in the chamber thus forms a pressure head causing the liquid to wet both the upper and lower lips 39, 41 of the slot and to be extruded horizontally outwardly through slot 38 and whereupon it falls down the vertical surface 43 to establish a thin falling curtain. It is found that surface tension effects due to the wetting of the upper slot lip 39 and the wall surface 43 produces a marked thinning of the extruded liquid and the curtain which is established on surface 43 is much thinner than the vertical width of the slot, i.e. the distance between the upper and lower slot lips 39, 41. This thin curtain or film falls away from the surface 43 at the sharp blade edge 40 to drop from the coater as a free falling curtain. The rounding of upper slot lip 39 assists in maintaining a film of constant thickness in that it minimises random variations in the wetted surface area at the lip which might otherwise upset the surface tension balance in the zone where the film is formed. The sharp blade edge 40 at the bottom of the surface 43 ensures that the film can fall away cleanly even though it is very thin and would tend to adhere to or run around a less sharp corner.

In one particular apparatus constructed in accordance with the invention the slot outlet of each curtain coater is 3mm wide and its upper and lower lips are rounded to 5mm diameter curvature. The starch solution or starch and clay suspension, as the case may be, is applied at a rate of 0.25 liter/second per meter width of coating onto a paper web travelling at 250 meters/minute. Coaters 23 and 24 receive an oxidised starch solution having 9% solids concentration and a viscosity of 30 seconds SteinHall cup at 18° C. Coater 25 receives a liquid comprised of 3% starch and 30% clay by weight. It has been found that this liquid has much the same viscosity as the starch solution pumped through coaters 23 and 24 and it can be forced through coater 25 at the same flow rate to produce a stable curtain which provides a clay distribution of about 20 grams per square meter which will significantly improve whiteness and opacity for printing.

Generally in order to ensure satisfactory results the slot outlets of the coaters may have a width in the range 1mm to 15mm with a minimum flow rate of about 0.1 liters/second per meter width of coating. The viscosity of the starch solution or starch and clay suspension may be in the range 18 seconds to 45 seconds SteinHall cup at 20° C.

Each coater is usually disposed with the outlet slot 38 facing in the direction of travel of the web and it may be tilted slightly so that surface 43 is not quite vertical but is inclined at an angle of approximately 10° to the vertical to minimise air entrainment and stress in the film and thereby promote smooth application of the film to the moving ply surface.

The illustrated apparatus and the board-making process carried out on that apparatus have been described by way of example only and could be varied considerably. For example, the starch layers applied between the intermediate plies could be eliminated. Moreover it is not essential that processes according to the invention be carried out on an Inverform machine and it would be possible to use other types of formers where vertical access to the paper web can be achieved. It has already been mentioned that titanium dioxide could be used as pigment material either to supplement or replace the clay, and a wide range of liquid binders could also be used. It is accordingly to be understood that the invention is in no way limited to the illustrated apparatus or the details of the described process and that many variations will fall within the scope of the appended claims.

We claim:

1. A method of making multi-ply paperboard, comprising the steps of forming a first ply and building further plies onto the first ply, wherein a suspension of pigment particles in a liquid binder is spread on at least one of the ply surfaces onto which the further plies are formed and before the respective further ply is formed, the suspension being spread on said ply surface by moving said ply surface horizontally in an upwardly facing condition, forcing the suspension through a horizontal slot so that it wets both upper and lower edges of the slot and is extruded generally horizontally from the slot to fall downwardly under gravity across an upright surface of a wall which terminates at a bottom blade edge located above the horizontally moving said ply surface whereby to establish a falling curtain of said suspension over said surface which curtain is thinner than the vertical width of the slot and allowing the established curtain to fall away from said surface at the blade edges and thence onto said ply surface.

2. A method as claimed in claim 1, wherein said one ply surface is that surface onto which the outermost ply is formed.

3. A method as claimed in claim 2, wherein said suspension comprises at least about 3% of starch by weight.

4. A method as claimed in claim 2, wherein the pigment particles are comprised of clay particles which are spread on said one ply surface at a distribution of between about 20 grams per square meter and 60 grams per square meter.

5. A method as claimed in claim 4, wherein said suspension comprises at least about 3% of starch by weight.

* * * * *